US005614823A

United States Patent [19]

Katayama et al.

[11] Patent Number: 5,614,823

[45] Date of Patent: Mar. 25, 1997

[54] APPARATUS AND METHOD FOR MEASURING HEAD SPEED AND OPENING ANGLE USING SIX SENSORS ARRANGED IN A RECTANGULAR FORMAT

[75] Inventors: Hiroyuki Katayama, Himeji; Shinji Ohshima, Akashi; Takashi Teraguchi, Kakogawa, all of Japan

[73] Assignee: Sumitomo Rubber Industries, Ltd., Kobe, Japan

[21] Appl. No.: 421,315

[22] Filed: Apr. 13, 1995

[30] Foreign Application Priority Data

Apr. 18, 1994 [JP] Japan ..... 6-104867

[51] Int. Cl.[6] ..... G01P 3/68; A63B 69/36

[52] U.S. Cl. ..... 324/178; 423/221; 423/409

[58] Field of Search ..... 273/187.1, 35 R, 273/183.1, 191 R, 192, 195 R; 324/178, 175

[56] References Cited

U.S. PATENT DOCUMENTS

| | | | |
|---|---|---|---|
| 3,601,408 | 8/1971 | Wright | 273/183 A |
| 4,254,956 | 3/1981 | Rusnak | 273/187.1 |
| 4,304,406 | 12/1981 | Cromarty | 273/187.1 |
| 4,342,455 | 8/1982 | Miyamae | 273/187.1 |
| 4,615,526 | 10/1986 | Yasuda et al. | 273/183 A |
| 4,958,836 | 9/1990 | Onozuka et al. | 273/187.1 |
| 5,419,562 | 5/1995 | Cromarty | 273/187.1 |
| 5,435,547 | 7/1995 | Lee | 273/187.1 |

*Primary Examiner*—Sandra L. O'Shea
*Assistant Examiner*—Roger Phillips
*Attorney, Agent, or Firm*—Armstrong, Westerman, Hattori, McLeland & Naughton

[57] ABSTRACT

An apparatus and a method for measuring head speed and an opening angle. At least four sensors are disposed at each vertex of a defined rectangle. An instrumentation device measures differences in time between instants in which a moving head intercepts rays of light toward the sensors, respectively. An arithmetic unit calculates head speed and an opening angle on the basis of the measured time differences.

6 Claims, 6 Drawing Sheets

The Moving Direction of the Head

APPARATUS AND METHOD FOR MEASURING HEAD SPEED AND OPENING ANGLE USING SIX SENSORS ARRANGED IN A RECTANGULAR FORMAT

BACKGROUND OF THE INVENTION

1. Field of the Invention

The present invention relates to an apparatus and method for measuring head speed and an opening angle.

2. Description of the Related Art

An opening angle of a club face just before an impact is an important factor influencing the direction of flight of a golf ball, and it is extremely important for a golfer to know the opening angle. "An opening angle" is defined as an angle of inclination of a face of a golf club head against a perpendicular plane to an optimum flying direction of a ball (a desired direction of the flight of the ball) when projected on a top plan view.

In a conventional method, an opening angle of a head is measured through picture processing, in which a reflective piece is attached to a club head, the club head is photographed using a flash while the club is swung, the picture is processed, and the opening angle of the head is obtained. In the method utilizing picture processing, the measuring apparatus as a whole is extremely complicated and an opening angle can be measured only with limited accuracy.

It is therefore an object of the present invention to provide an apparatus and method for measuring head speed and an opening angle, in which head speed and an opening angle are measured with increased accuracy.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
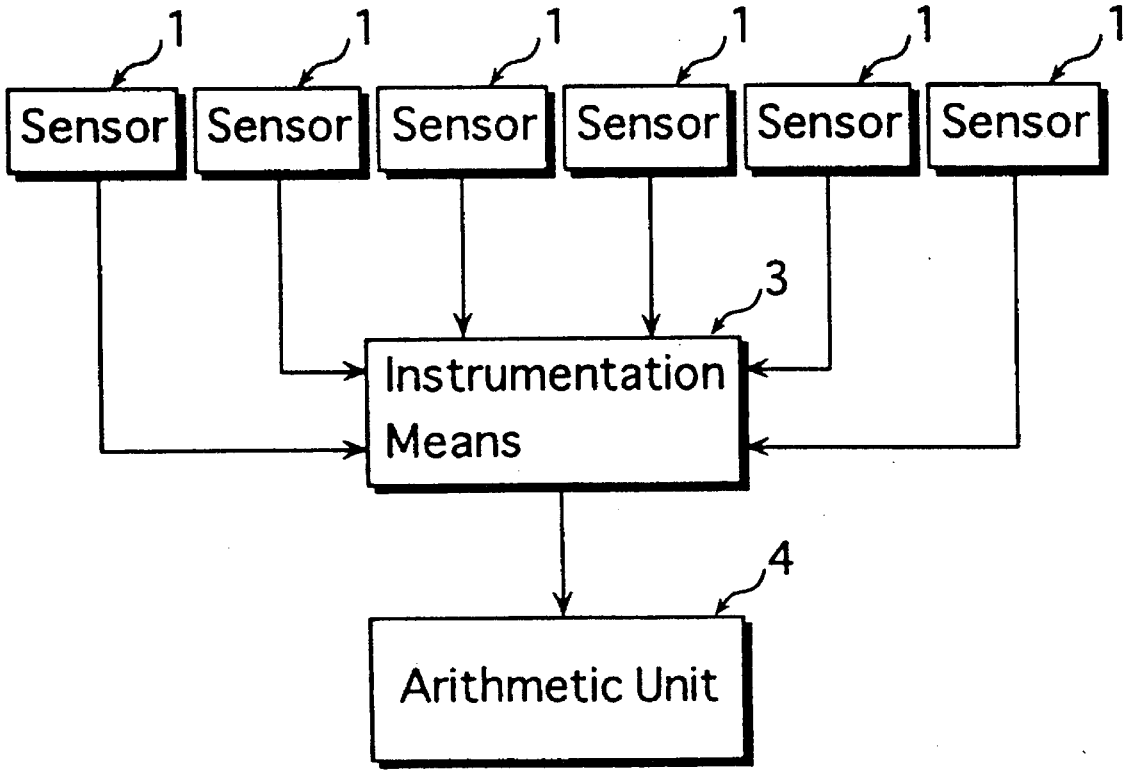
FIG. 1 is a schematic block diagram showing an embodiment of the apparatus for measuring head speed and an opening angle according to the present invention.

FIG. 1 shows a schematic block diagram of an apparatus for measuring head speed and an opening angle according to the present invention, and this apparatus is provided with a plurality of (for example, six) sensors 1, an instrumentation means 3 for measuring time differences between instants in which a moving head 2 (see FIG. 2 and FIG. 3) intercepts rays of light toward the sensors 1 respectively, and an arithmetic unit 4 for calculating head speed and an opening angle on the basis of the time differences.

Figure 2:
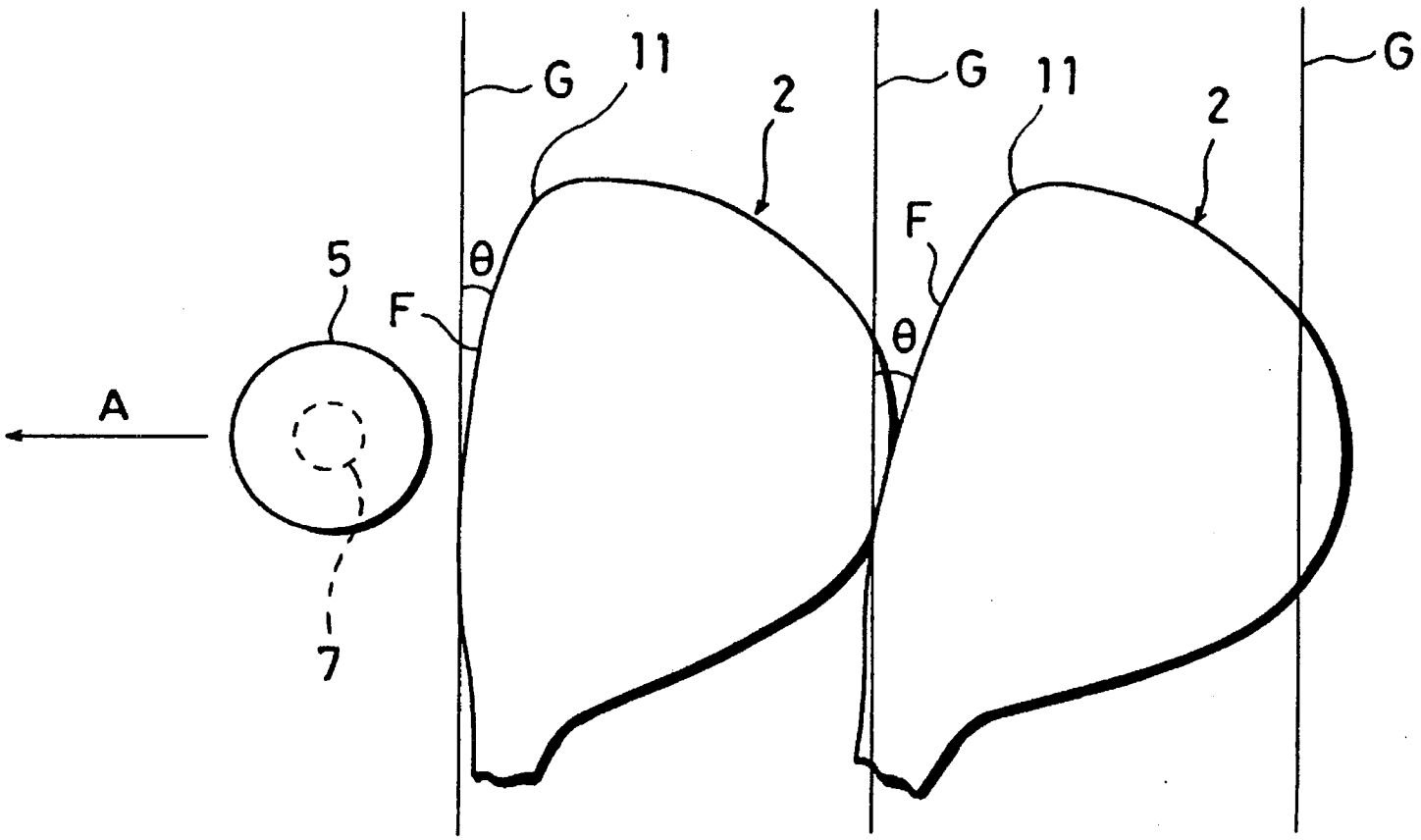
FIG. 2 is an explanatory view showing an opening angle under an opening situation.
Figure 3:
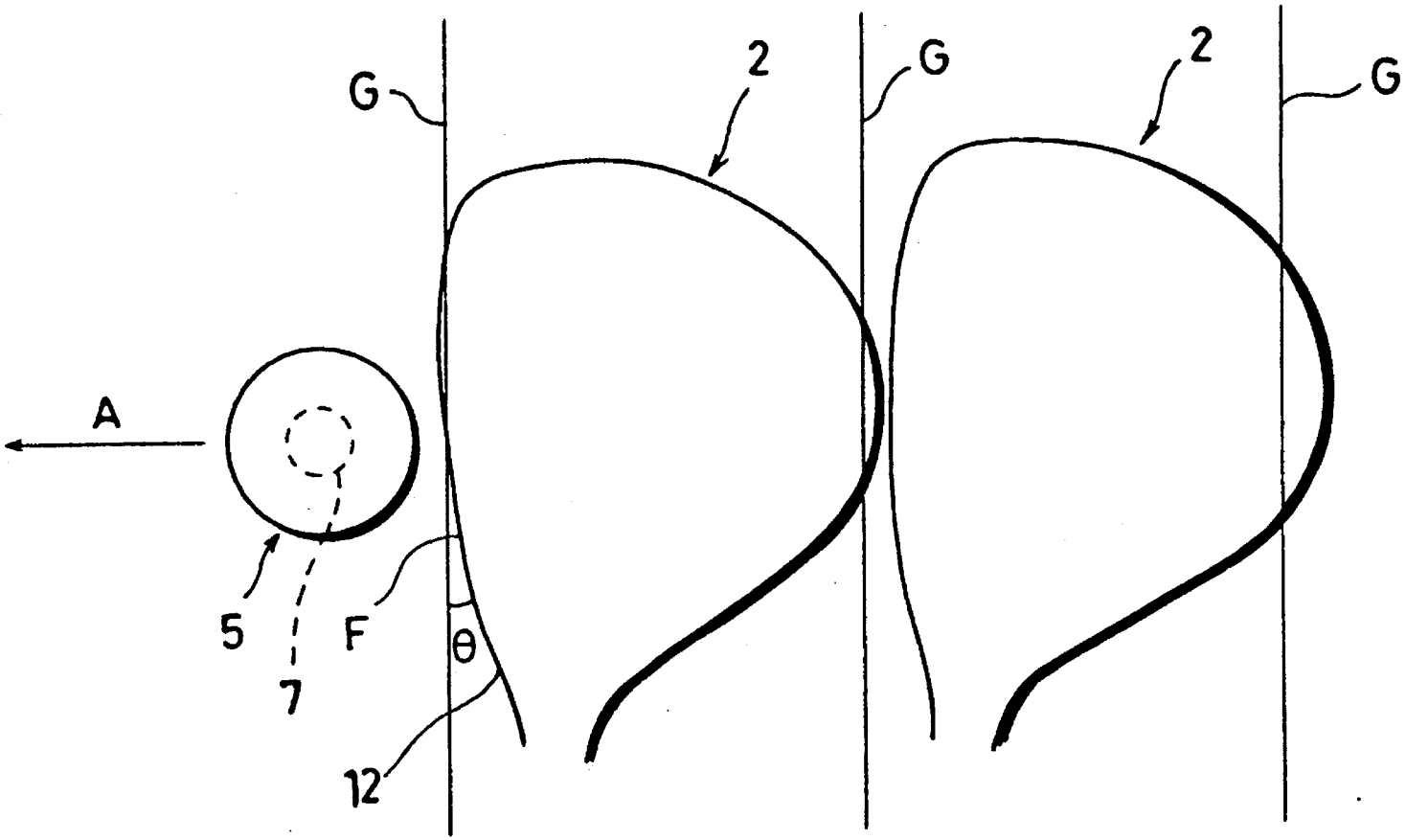
FIG. 3 is an explanatory view showing an opening angle under a closing situation.

An opening angle is, as shown in FIG. 2 and in FIG. 3, an angle θ a face F of a head 2 is inclined from a perpendicular plane G to an optimum flying direction A of a golf ball 5. As shown in FIG. 2, "an opening situation" is defined as a situation the toe 11 is inclined toward the direction parting from the ball 5, and as shown in FIG. 3, "a closing situation" is defined as a situation wherein the heel 12 is inclined toward the direction parting from the ball 5. The ball 5 slices when the ball 5 is shot under "an opening situation", and the ball 5 hooks when the ball 5 is shot under "a shutting situation".

Figure 4:
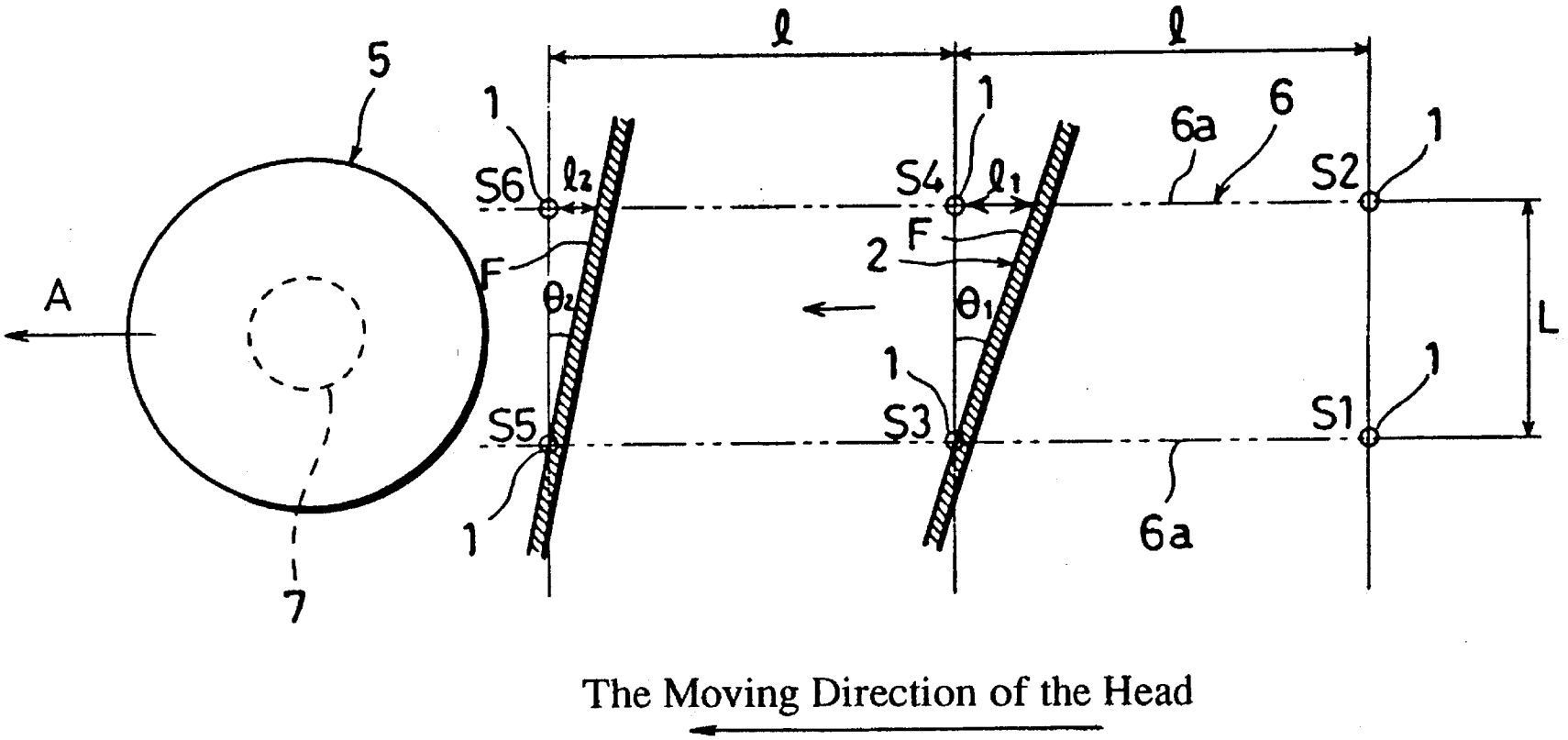
FIG. 4 is an explanatory view for the arithmetic operation method.

As shown in FIG. 4, the sensors 1 are disposed at each vertex of a rectangle 6 (the position and the dimensions in length of each of the sides are known) and the middle points of the long sides *6a* of the rectangle 6. These sensors 1 are light sensors detecting light from ray projecting means (projectors), not shown in the attached drawings, arranged to be corresponding to the sensors 1. When the head 2 passes above a sensor 1 and intercepts a ray of light from a projector into the sensor 1, the sensor 1 detects the interception of light. The intervals L and l are arranged so that the head 2 intercepts rays of light toward the sensors 1 ($S_1$, $S_2$, $S_3$, $S_4$, $S_5$, and $S_6$) respectively.

The instrumentation means 3 having a plurality of (to be specific, a number corresponding to the number of the sensors 1) counters which measure time when an output from an amplifier portion is under a definite value, and inputs the data into the arithmetic unit (the computer) 4. The amplifier portion performs automatic gain control so that an output is amplified to a definite electric power level upon incidence of light from a projector into a sensor 1.

The arithmetic unit 4 calculates head speed and an opening angle by measuring differences in time between moments the sensors 1 respectively detect interception of light caused by the head 2 as explained below.

First, as shown in FIG. 4, defining $\theta_1$ as the opening angle of the head 2 at the moment of passing above the sensor 1 of $S_3$, and $l_1$ as the distance from the sensor 1 of $S_4$ to the head 2 at this moment, the following equation is obtained.

$$l_1=V_{2,4}\times t_{3,4}$$

In this case, $V_{2,4}$ is the average head speed between the sensor 1 of $S_2$ and the sensor 1 of $S_4$, and $V_{2,4}=l/t_{2,4}$. $t_{2,4}$ is the time length from the moment the head 2 intercepts light toward the sensor 1 of $S_2$ to the moment the head 2 intercepts light toward the sensor 1 of $S_4$. Defining $t_{3,4}$ as the time length from the moment the head 2 intercepts light toward the sensor 1 of $S_3$ to the moment the head 2 intercepts light toward the sensor 1 of $S_4$, $\tan\theta_1=l_1/L$, therefore $\theta_1$ is obtained from the equation, $\tan\theta_1=(V_{2,4}\times t_{3,4})/L$.

In the same manner, defining $\theta_2$ as the opening angle of the head 2 at the moment of passing above the sensor 1 of $S_5$, and $l_2$ as the distance from the sensor 1 of $S_6$ to the head 2 at this moment, the following equation is obtained.

$$l_2=V_{4,6}\times t_{5,6}$$

In this case, $V_{4,6}$ is the average head speed between the sensor 1 of $S_4$ and the sensor 1 of $S_6$, and $V_{4,6}=l/t_{4,6}$. $t_{4,6}$ is the time length from the moment the head 2 intercepts light toward the sensor 1 of $S_4$ to the moment the head 2 intercepts light toward the sensor 1 of $S_6$. Defining $t_{5,6}$ as the time length from the moment the head 2 intercepts light toward the sensor 1 of $S_5$ to the moment the head 2 intercepts light toward the sensor 1 of $S_6$, $\tan\theta_2=l_2/L$, therefore $\theta_2$ is obtained from the equation, $\tan\theta_2=(V_{4,6}\times t_{5,6})/L$.

A change in the opening angle of the head 2 is obtained by comparing the obtained $\theta_1$ and $\theta_2$. $V_{1,3}$ (the average head speed between $S_1$ and $S_3$), $V_{3,5}$ (the average head speed between $S_3$ and $S_5$), and $V_{4,6}$ (the average head speed between $S_4$ and $S_6$) are also obtained, and acceleration of the head is judged by comparing $V_{2,4}$ and $V_{4,6}$, and $V_{1,3}$ and $V_{3,5}$.

Next, an example represented by an actual experiment is described.

Figure 5:
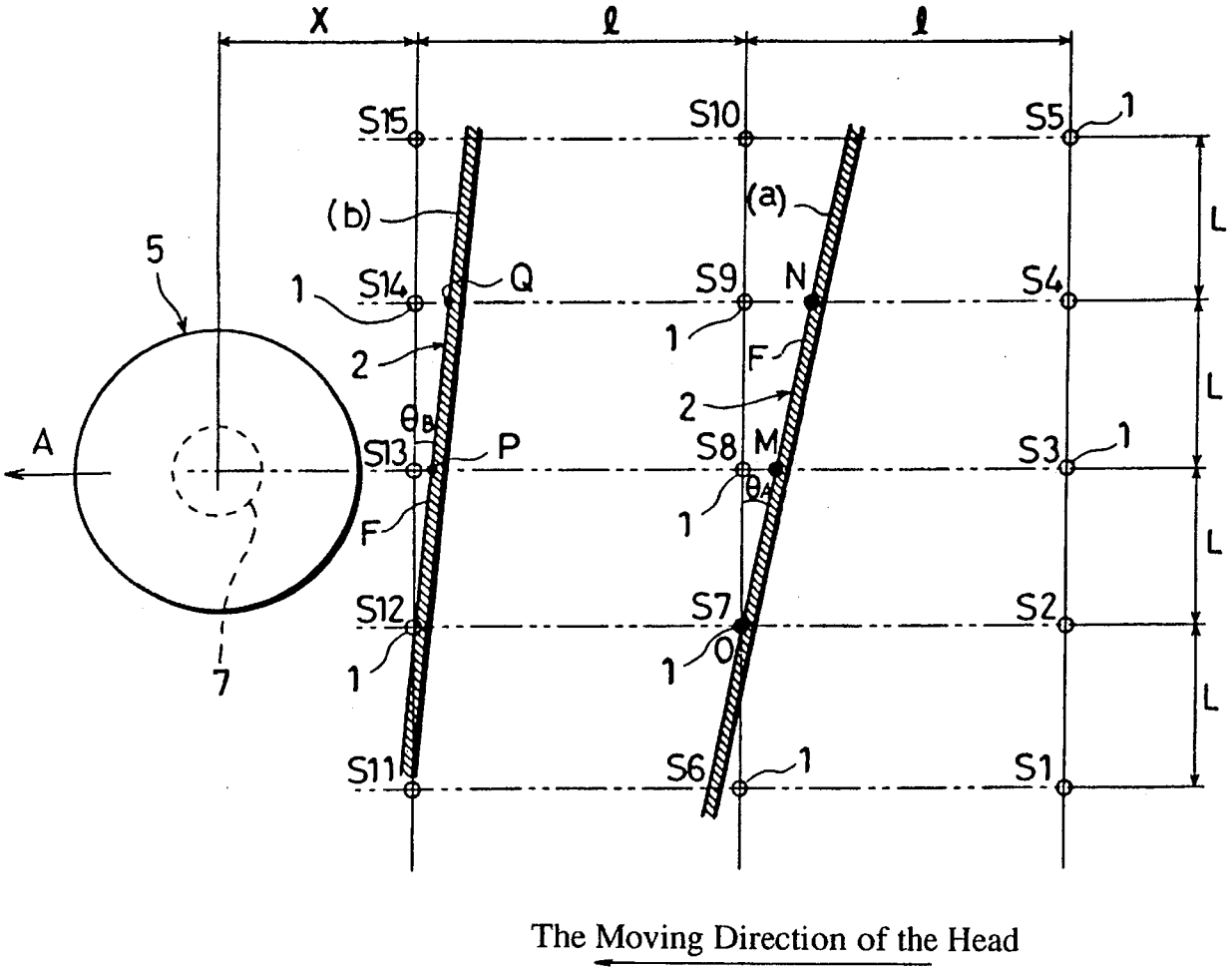
FIG. 5 is an explanatory view for the arithmetic operation method.

As shown in FIG. 5, fifteen sensors 1 of $S_1$–$S_{15}$ are arranged at intervals L and intervals l forming a lattice-shaped configuration. In this case, the intervals L are 25 mm, and the intervals l are 50 mm, and the distance X from the sensor 1 of $S_{13}$ to the center of the tee 7 is 30 mm. In consideration of the length of the club face, the data of $S_2$–$S_4$, $S_7$–$S_9$, and $S_{12}$–$S_{14}$ are to be used for analysis. $\theta_A$ is the opening angle of the head 2 when the golf club is swung and the head 2 is at (a), and $\theta_B$ is the opening angle of the head 2 when the head 2 is at (b).

In this case, $$m=V_{3,8}\times t_{7,8}$$

m: the distance from $S_8$ to M $V_{3,8}$: the average speed between $S_3$ and $S_8$ (m/sec)

$t_{7,8}$: the time length from the moment $S_7$ detects interception of light to the moment $S_8$ detects interception of light (sec.)

$$n=V_{4,9}\times t_{7,9}$$

n: the distance from $S_9$ to N $V_{4,9}$: the average speed between $S_4$ and $S_9$ (m/sec)

$t_{7,9}$: the time length from the moment $S_7$ detects interception of light to the moment $S_9$ detects interception of light (sec.)

The face F of the head 2 is not always representative of a straight line when projected on a top plan view, however, accurate data is obtained by regarding the line of linear correlation of the three points, O, M, and N, as the head face and defining $\theta_A$ as the opening angle. That is to say, tan $\theta_A=1/\alpha$ ($\alpha$ is the inclination of the obtained line.)

$\theta_B$ is obtained in the same manner, and a change in the opening angle of the head 2 is obtained by comparing $\theta_B$ and $\theta_A$.

In this case, the average speed $V_{3,13}$ between $S_3$ and $S_{13}$ is measured as the head speed, therefore whether the head accelerates prior to impact is judged by comparing $V_{3,8}$ (the average speed between $S_3$ and $S_8$) and $V_{8,13}$ (the average speed between $S_8$ and $S_{13}$). Moreover, data of the toe 11 is obtained from $V_{4,9}$ (the average speed between $S_4$ and $S_9$) and $V_{9,14}$ (the average speed between $S_9$ and $S_{14}$), and data of the heel 12 is obtained from $V_{2,7}$ (the average speed between $S_2$ and $S_7$) and $V_{7,12}$ (the average speed between $S_7$ and $S_{12}$).

The values obtained in the experiment are $t_{2,7}$=13451, $t_{7,12}$=13237, $t_{3,8}$=13077, $t_{8,13}$=12991, $t_{4,9}$=12772, $t_{9,14}$=12686, $t_{7,8}$=327, $t_{7,9}$=758, $t_{12,13}$=81, $t_{12,14}$=207, and $t_{3,13}$=26068. In this case, these values are expressed in $\times10^{-7}$ sec., and $t_{i,j}$ expresses the time interval between moments a sensor i detects interception of light and a sensor j detects interception of light.

Calculating as described above on the basis of the respective time differences, $V_{2,7}$=37.17, $V_{7,12}$=37.77, $V_{3,8}$=38.24, $V_{8,13}$=38.49, $V_{4,9}$=39.15, $V_{9,14}$=39.41, and $V_{3,13}$=38.36. In this case, these values are expressed in m/sec, and $V_{i,j}$ expresses the average speed between a sensor i and a sensor j.

In the experiment, the head speed $V_{3,13}$ is 38.36 m/sec, $\theta_A$ is 3.42°, and $\theta_B$ is 0.95°.

Comparing $V_{3,8}$ (38.24 m/sec) and $V_{8,13}$ (38.49 m/sec), $V_{8,13}>V_{3,8}$, which shows that the head 2 accelerates prior to impact. $V_{7,12}<V_{8,13}<V_{9,14}$, and this shows that the toe 11 of the head 2 moves faster than the heel 12 of the head 2.

FIG. 4 and FIG. 5 show opening situations of the head 2. However, the head 2 is in a closing or shutting situation in some cases. Whether the head 2 is in an opening situation or in a shutting situation is judged from the order the sensors 1 detect interception of light.

Figure 6:
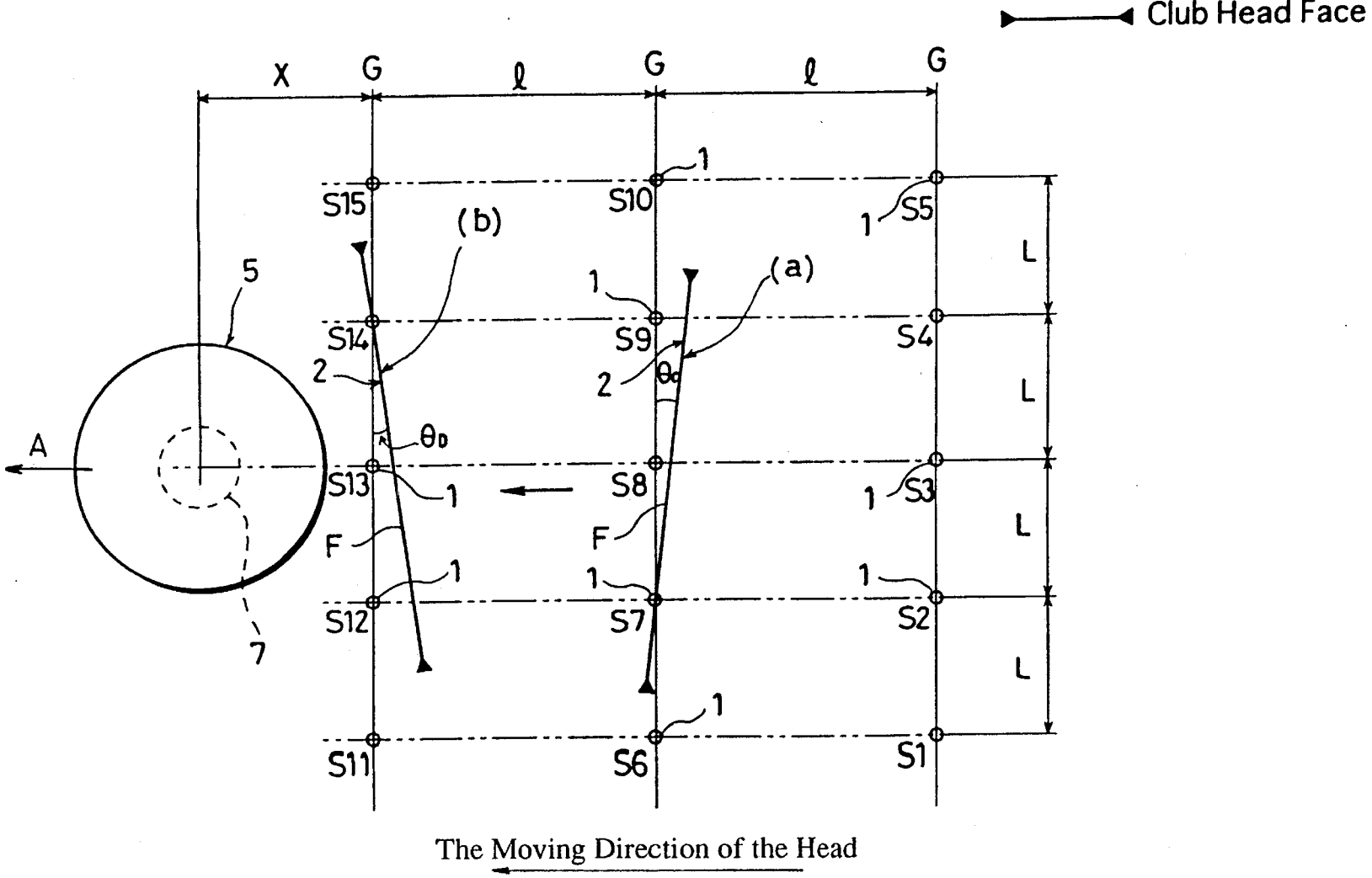
FIG. 6 is an explanatory view for the judging method whether a head is in an opening situation or in a shutting situation.

That is to say, the situation of (a) of FIG. 6 is judged to be an opening situation because the order of detecting interception of light is $S_7$, $S_8$, and $S_9$, and the situation of (b) is judged to be a closing situation because the order of detecting interception of light is $S_{14}$, $S_{13}$, and $S_{12}$. $\theta_C$ and $\theta_D$ are obtained through the foregoing calculation method.

While six sensors 1 are used in the foregoing embodiment and fifteen sensors 1 are used in the experiment in the example, the number of the sensors 1 can be four, in which the sensors 1 are disposed at each vertex of a definite rectangle 6. Head speed and an opening angle in this case can be also obtained through the foregoing calculation method (although it is not possible to judge whether the head 2 accelerates or not in this case).

The sensors 1 can be freely changed in the number and the distance of the various intervals, however, head speed and an opening angle are obtained with higher accuracy when many sensors 1 are disposed at relatively small intervals.

The apparatus and the method for measuring head speed and an opening angle according to the present invention can be also used for measuring speed and an opening angle of a baseball bat or a tennis racket in addition to a golf head.

Head speed and an opening angle are obtained as described in the foregoing, therefore it is possible to perform indication of judgement (output of judgement) of head speed and an opening angle if the arithmetic method is programmed beforehand.

A transmission type ray projecting and receiving system is used in the embodiments, however, the same effect is obtained when a reflection type ray projecting and receiving system is used.

According to the present invention, head speed and an opening angle are measured easily and accurately. Especially when at least six sensors are used, head acceleration besides head speed and an opening angle can be measured with high accuracy. The apparatus as a whole is not complicated, and the cost is low. Moreover, whether the head is in "an opening situation" or in "a closing situation" is judged accurately.

While preferred embodiments of the present invention have been disclosed and described in the specification and claims, it is to be understood that these embodiments are merely illustrative and not restrictive, because various changes are possible within the spirit and scope of the claims.

We claim:

1. An apparatus for measuring head speed and an opening angle of a moving head as it impacts a projectile, comprising:

at least six sensors, four of said sensors being disposed each at a vertex of a defined rectangle and at least two of said sensors being disposed each on an opposed long side of said rectangle for detecting interception of light caused by said moving head;

an instrumentation means for measuring time differences between instants in which the moving head intercepts rays of light aimed toward the sensors, respectively; and an arithmetic unit for calculating head speed and an opening angle on the basis of the time differences measured by said instrumentation means.

2. An apparatus for measuring head speed and an opening angle of a moving head as it impacts a projectile, comprising:

at least six sensors, four of said sensors being disposed each at a vertex of a defined rectangle and at least two of said sensors being disposed each on an opposed long side of said rectangle for detecting interception of light caused by said moving head;

an instrumentation means for measuring time differences between instants in which the moving head intercepts rays of light aimed toward the sensors, respectively; and an arithmetic unit for calculating head speed, an opening angle, head acceleration, and a change in the opening angle on the basis of the time differences measured by said instrumentation means.

3. The apparatus for measuring head speed and an opening angle as set forth in claim 1 or claim 2, wherein the sensors are light sensors for detecting light from light projectors.

4. A method for measuring head speed and an opening angle of a moving head as it impacts a projectile, in which four sensors are each disposed at a vertex of a defined rectangle and at least two sensors are each disposed on an opposed long side of said rectangle, comprising the steps of:

intercepting successive rays of light aimed toward the sensors by motion of the moving head;

measuring time differences between instants in which the moving head intercepts rays of light aimed toward the sensors, respectively; and calculating both a head speed and an opening angle on the basis of the measured time differences.

5. A method for measuring head speed and an opening angle of a moving head as it impacts a projectile, in which four sensors are each disposed at a vertex of a defined rectangle and at least two sensors are each disposed on an opposed long side of said rectangle, comprising the steps of:

intercepting successive rays of light aimed toward the sensors by motion of the moving head;

measuring time differences between instants in which the moving head intercepts rays of light aimed toward the sensors, respectively; and calculating head speed, an opening angle, head acceleration, and change in the opening angle on the basis of the measuring time differences.

6. The apparatus for measuring head speed and an opening angle as set forth in claim 1 or claim 2, wherein one pair of opposing faces of the rectangle are arranged perpendicular to the direction of the intended path of the club-head.

* * * * *